US006464208B1

(12) United States Patent
Smith

(10) Patent No.: US 6,464,208 B1
(45) Date of Patent: Oct. 15, 2002

(54) I-BEAM WALK ASSIST DEVICE

(76) Inventor: Donald E. Smith, 1620 W. Wickieup La., Phoenix, AZ (US) 85027

( * ) Notice: Subject to any disclaimer, the term of this patent is extended or adjusted under 35 U.S.C. 154(b) by 91 days.

(21) Appl. No.: 09/776,370

(22) Filed: Feb. 2, 2001

(51) Int. Cl.[7] ..... B66D 1/00
(52) U.S. Cl. ..... 254/324; 212/97
(58) Field of Search ..... 254/324, 325, 254/326, 329, 335; 212/74, 83, 87, 94, 97

(56) References Cited

U.S. PATENT DOCUMENTS 298,405 A * 5/1884 Reitz ..... 254/324
724,579 A * 4/1903 Hysore ..... 254/324
1,239,524 A * 9/1917 Root ..... 212/345
2,533,999 A * 12/1950 Colley ..... 254/324
3,494,492 A * 2/1970 Theirmann ..... 212/175
5,138,953 A * 8/1992 Horcher et al. ..... 104/89
5,299,033 A * 3/1994 Watanabe et al. ..... 254/266
5,337,908 A * 8/1994 Beck, Jr. ..... 104/126
5,427,356 A * 6/1995 Krotov et al. ..... 182/129
5,456,655 A * 10/1995 Morris ..... 128/846
5,772,183 A * 6/1998 Sears ..... 248/333
6,015,137 A * 1/2000 Guevara et al. ..... 254/323
6,068,240 A * 5/2000 Leveugle ..... 254/277
6,098,216 A * 8/2000 Williamson et al. ..... 5/83.1
6,202,868 B1 * 3/2001 Murray ..... 212/227
6,289,534 B1 * 9/2001 Hakamiun et al. ..... 5/83.1

* cited by examiner

*Primary Examiner*—Emmanuel M. Marcelo
(74) *Attorney, Agent, or Firm*—Joseph N. Breaux

(57) ABSTRACT

A walk assist device including a mechanism for mechanically providing a lifting force to lift a patient from a seated position and provide a weight support force to a patient at an individually adjusted height level along the length of an exercise run.

1 Claim, 2 Drawing Sheets

I-BEAM WALK ASSIST DEVICE

TECHNICAL FIELD

The present invention relates to rehabilitative exercise equipment and more particularly to an I-beam walk assist device that includes first and second individually adjustable height I-beam support assemblies, an I-beam having a first beam end supported by the first adjustable height I-beam support assembly and a second I-beam end supported by the second adjustable height I-beam support assembly, a gantry crane rollably mounted onto the I-beam and rollable along a section of the I-beam, a first and a second user controlled I-beam support assembly height adjustment winch in mechanical connection, respectively, with one of the first or second individually adjustable height I-beam support assemblies, and a patient harness connecting mechanism in connection with the gantry crane and having attachment structures for attaching a patient support harness; the gantry crane including a rollable trolley supporting a user controllable electric patient support winch having a lift/lower control device that includes an extend/retract switch mechanism for allowing an operator to extend and retract a flexible support cable connected at one end to a winch spool of the user controllable electric patient support winch and in mechanical lifting connection with the patient harness connecting mechanism; each of the first and second individually adjustable height I-beam support assemblies including a horizontal support member, an outer vertical support tube extending upward from a top center of the horizontal support member and having a tubular passageway therein open at a top outside tube end thereof and an outer vertical support tube surface to which a guide tube with a guide tube passageway is rigidly attached, and an inner vertical support assembly having an elongated inner slide portion slidably positioned in connection with the tubular passageway of the outer vertical support tube, a top plate mounted to a top slide portion end in connection with a respective first or second beam end, and an elongated lifting member in parallel orientation with the elongated inner slide portion, in mechanical force transmitting connection with the elongated inner slide portion and slidably positioned in connection with the guide tube passageway of the guide tube; each of the first and second user controlled height adjustment winches being in mechanical connection with a respective one of the first and second individually adjustable height I-beam support assemblies, and having a height adjust extend/retract control switch mechanism for controlling the direction of rotation of a height adjust cable spool and a height adjust cable having a spool connecting end in connection with the height adjust cable spool and a lifting member connecting end in connection with the lifting member such that when the height adjust cable spool rotates in a first rotational direction, the height adjust cable supplies a lifting force to the elongated lifting member such that the respective first or second beam end is raised and when the height adjust cable spool rotates in a second rotational direction, opposite to the first rotational direction, the height adjust cable supplies a lowering force to the elongated lifting member such that the respective first or second beam end is lowered; the height of the first and second beam ends being adjustable to the same or different heights by an operator.

BACKGROUND OF INVENTION

It is often difficult for health care providers to provide the necessary lifting force to assist patients engaged in walking types of physical therapy because they do not have the physical strength to maintain the required lifting assistance needed by the patient to support the patients weight entirely or partially while the patient engages in walking type exercises, such as free walking or walking on a treadmill or the like. It would be a benefit, therefore, to have an I-beam walk assist device which would provide a caretaker with a mechanism for mechanically providing a lifting force to lift a patient from a seated position and which would could then be used to provide a weight support force to a patient at a predetermined individually adjusted height level, wherein the mechanism moved with the patient and, therefore, provided the weight support force to the patient along the length of an exercise run. This would allow patients connected to the I-beam walk assist device with a parachute harness or the like to rely on the weight support force available to them from the I-beam walk assist device while they used their own muscle power to provide the force necessary to move forward and backward along the length of the exercise run. It would be a further benefit to have an I-beam walk assist device wherein the I-beam may be oriented at an angle with respect to the ground so that the support height along the I-beam varies. When a patient walks toward the lowest side of the I-beam the support height becomes gradually lower, according to the angle of the I-beam, requiring the patient to support some or all of his/her weight and providing an exercise effect and a mechanism for gradually weaning the patient from the walk assist device.

SUMMARY OF INVENTION

It is thus an object of the invention to provide an I-beam walk assist device that includes first and second individually adjustable height I-beam support assemblies, an I-beam having a first beam end supported by the first adjustable height I-beam support assembly and a second I-beam end supported by the second adjustable height I-beam support assembly, a gantry crane rollably mounted onto the I-beam and rollable along a section of the I-beam, a first and a second user controlled I-beam support assembly height adjustment winch in mechanical connection, respectively, with one of the first or second individually adjustable height I-beam support assemblies, and a patient harness connecting mechanism in connection with the gantry crane and having attachment structures for attaching a patient support harness; the gantry crane including a rollable trolley supporting a user controllable electric patient support winch having a lift/lower control device that includes an extend/retract switch mechanism for allowing an operator to extend and retract a flexible support cable connected at one end to a winch spool of the user controllable electric patient support winch and in mechanical lifting connection with the patient harness connecting mechanism; each of the first and second individually adjustable height I-beam support assemblies including a horizontal support member, an outer vertical support tube extending upward from a top center of the horizontal support member and having a tubular passageway therein open at a top outside tube end thereof and an outer vertical support tube surface to which a guide tube with a guide tube passageway is rigidly attached, and an inner vertical support assembly having an elongated inner slide portion slidably positioned in connection with the tubular passageway of the outer vertical support tube, a top plate mounted to a top slide portion end in connection with a respective first or second beam end, and an elongated lifting member in parallel orientation with the elongated inner slide portion, in mechanical force transmitting connection with the elongated inner slide portion and slidably positioned in connection with the guide tube passageway of the guide tube; each of the first and second user controlled height adjustment winches being in mechanical connection with a respective one of the first and second individually adjustable height I-beam support assemblies, and having a height adjust extend/retract control switch mechanism for controlling the direction of rotation of a height adjust cable spool and a height adjust cable having a spool connecting end in connection with the height adjust cable spool and a lifting member connecting end in connection with the lifting member such that when the height adjust cable spool rotates in a first rotational direction, the height adjust cable supplies a lifting force to the elongated lifting member such that the respective first or second beam end is raised and when the height adjust cable spool rotates in a second rotational direction, opposite to the first rotational direction, the height adjust cable supplies a lowering force to the elongated lifting member such that the respective first or second beam end is lowered; the height of the first and second beam ends being adjustable to the same or different heights by an operator.

Accordingly, an I-beam walk assist device is provided. The I-beam walk assist device includes first and second individually adjustable height I-beam support assemblies, an I-beam having a first beam end supported by the first adjustable height I-beam support assembly and a second I-beam end supported by the second adjustable height I-beam support assembly, a gantry crane rollably mounted onto the I-beam and rollable along a section of the I-beam, a first and a second user controlled I-beam support assembly height adjustment winch in mechanical connection, respectively, with one of the first or second individually adjustable height I-beam support assemblies, and a patient harness connecting mechanism in connection with the gantry crane and having attachment structures for attaching a patient support harness; the gantry crane including a rollable trolley supporting a user controllable electric patient support winch having a lift/lower control device that includes an extend/retract switch mechanism for allowing an operator to extend and retract a flexible support cable connected at one end to a winch spool of the user controllable electric patient support winch and in mechanical lifting connection with the patient harness connecting mechanism; each of the first and second individually adjustable height I-beam support assemblies including a horizontal support member, an outer vertical support tube extending upward from a top center of the horizontal support member and having a tubular passageway therein open at a top outside tube end thereof and an outer vertical support tube surface to which a guide tube with a guide tube passageway is rigidly attached, and an inner vertical support assembly having an elongated inner slide portion slidably positioned in connection with the tubular passageway of the outer vertical support tube, a top plate mounted to a top slide portion end in connection with a respective first or second beam end, and an elongated lifting member in parallel orientation with the elongated inner slide portion, in mechanical force transmitting connection with the elongated inner slide portion and slidably positioned in connection with the guide tube passageway of the guide tube; each of the first and second user controlled height adjustment winches being in mechanical connection with a respective one of the first and second individually adjustable height I-beam support assemblies, and having a height adjust extend/retract control switch mechanism for controlling the direction of rotation of a height adjust cable spool and a height adjust cable having a spool connecting end in connection with the height adjust cable spool and a lifting member connecting end in connection with the lifting member such that when the height adjust cable spool rotates in a first rotational direction, the height adjust cable supplies a lifting force to the elongated lifting member such that the respective first or second beam end is raised and when the height adjust cable spool rotates in a second rotational direction, opposite to the first rotational direction, the height adjust cable supplies a lowering force to the elongated lifting member such that the respective first or second beam end is lowered; the height of the first and second beam ends being adjustable to the same or different heights by an operator.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY EMBODIMENTS

Figure 1:
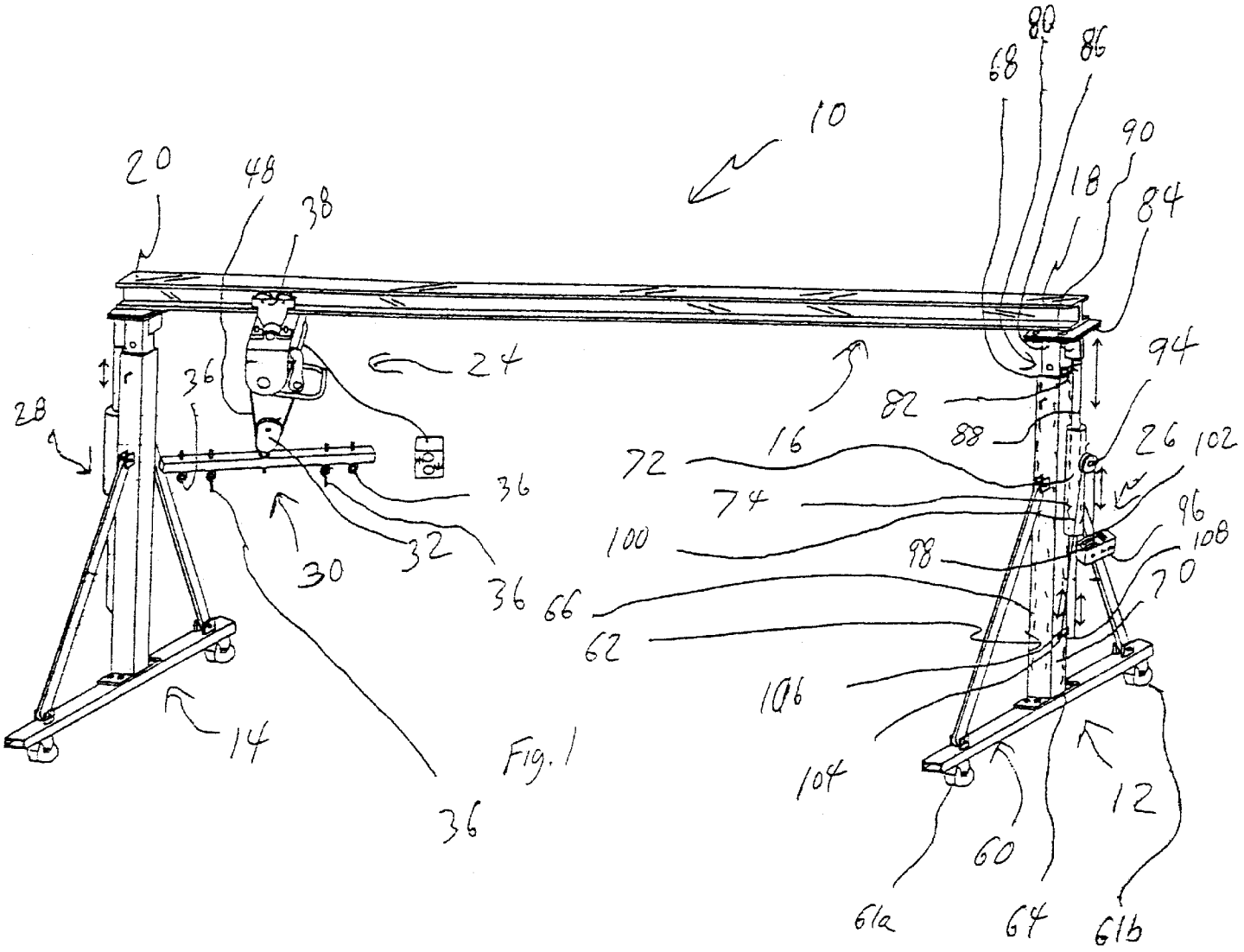
FIG. 1 is a perspective view of an exemplary embodiment of the I-beam walk assist device of the present invention.
Figure 2:
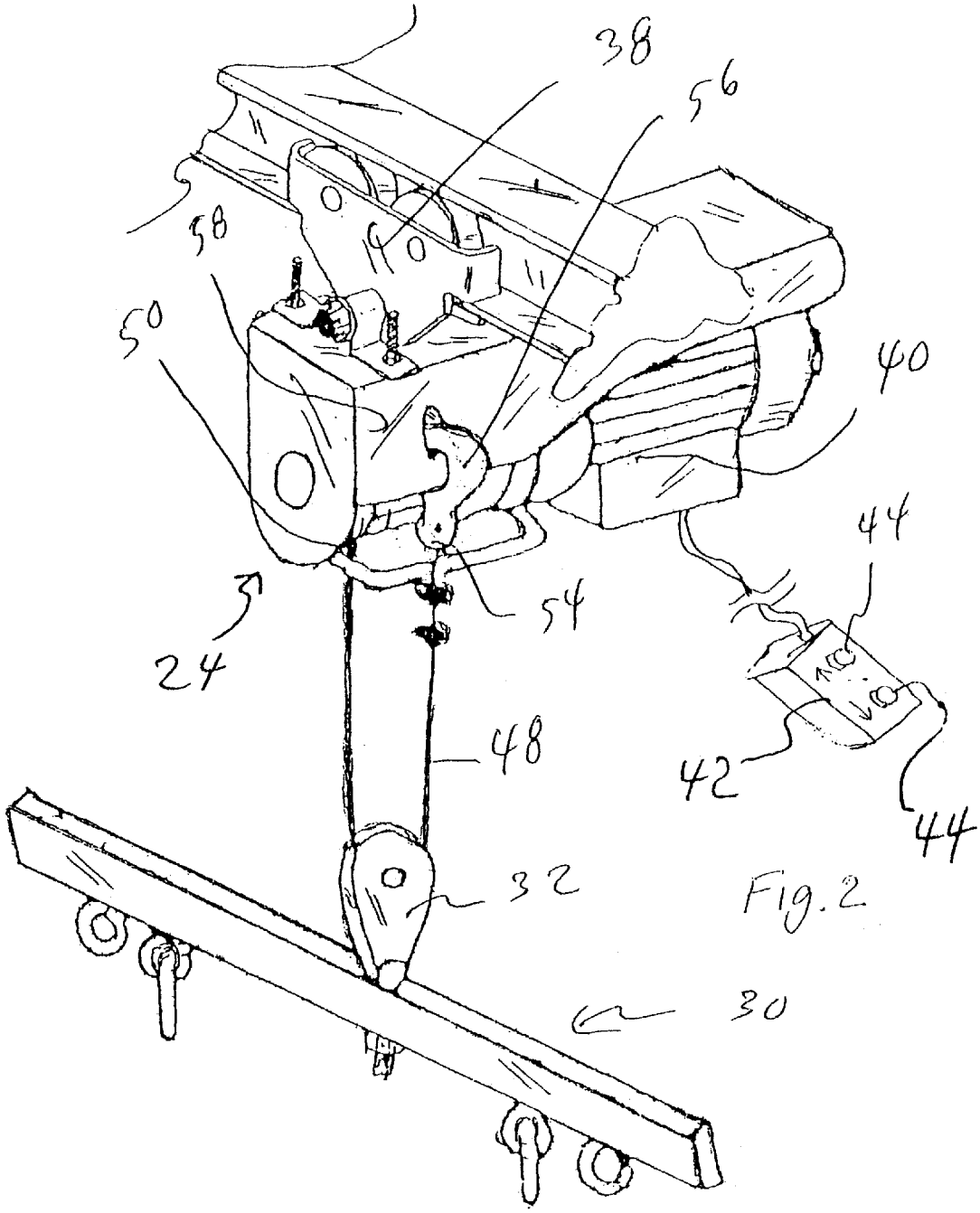
FIG. 2 is a partial perspective view of an exemplary gantry crane rollably mounted on a section of the I-beam.

FIGS. 1 and 2 show various aspects of an exemplary embodiment of the I-beam walk assist device of the present invention generally designated 10. I-beam walk assist device includes first and second individually adjustable height I-beam support assemblies, generally designated 12,14; an I-beam, generally designated 16, having a first beam end 18 supported by the first adjustable height I-beam support assembly 12 and a second I-beam end 20 supported by the second adjustable height I-beam support assembly 14; a gantry crane, generally designated 24, rollably mounted onto I-beam 16 and rollable along a section of the I-beam 16 between first and second adjustable height I-beam support assemblies 12,14; identical first and second user controlled I-beam support assembly height adjustment winches 26,28 (winch 28 not shown) in mechanical connection, respectively, with one of the first or second individually adjustable height I-beam support assemblies 12,14; and a patient harness connecting mechanism, generally designated 30 in connection with gantry crane 24 by attachment to a gantry pulley 32 and having attachment structures 36 for attaching a patient support harness.

Gantry crane 24 includes a rollable trolley 38 supporting a user controllable electric patient support winch 40 having a lift/lower control device 42 that includes an extend/retract switch mechanism 44 for allowing an operator to extend and retract a flexible support cable 48 connected at one end to a winch spool 50 of user controllable electric patient support winch 40, and in mechanical lifting connection with patient harness connecting mechanism 30 by passing through gantry pulley 32 and being connected at a second end 54 to a gantry hook 56 attached to a housing 58 of user controllable electric patient support winch 40. In operation, as flexible support cable 48 is extended from winch spool 50 patient harness connecting mechanism 30 is lowered and, as flexible support cable 48 is retracted onto winch spool 50 patient harness connecting mechanism 30 is raised.

First and second individually adjustable height I-beam support assemblies 12,14 and are mirror images of each other but are otherwise identical in construction. Although the following description is direct to first individually adjustable height I-beam support assemblies 12, the description is equally applicable to the structure and operation of second individually adjustable height I-beam support assemblies 14.

First individually adjustable height I-beam support assembly 12 includes a horizontal support member, generally designated 60 rollably mounted on locking two lockable wheel assemblies 61*a*,61*b*; an outer vertical support tube, generally designated 62, extending upward from a top center 64 of horizontal support member 60 and having a tubular passageway 66 therein (shown in dashed lines) open at a top outside tube end 68 thereof and an outer vertical support tube surface 70 to which a guide tube 72 with a guide tube passageway 74 (shown in dashed lines) is rigidly attached; and an inner vertical support assembly, generally designated 80, having an elongated inner slide portion, generally designated 82, slidably positioned in connection with tubular passageway 66 of outer vertical support tube 62, a top plate 84 mounted to a top slide portion end 86 in connection with first beam end 18, and an elongated lifting member 88 in parallel orientation with elongated inner slide portion 80, in mechanical force transmitting connection with the elongated inner slide portion 80 through a welded steel plate 90 and slidably positioned in connection with guide tube passageway 74 of guide tube 72. In this embodiment, guide tube 72 has a height adjustment cable receiving pulley assembly 94 connected to the outer surface thereof.

First user controlled height adjustment winch 26 is mounted to outer vertical support tube surface 70 of outer vertical support tube 62 at a location lower than height adjustment cable receiving pulley assembly 94 and includes a height adjust extend/retract control switch mechanism 96 for controlling the direction of rotation of a height adjust cable spool 98, and a height adjust cable 100 having a spool connecting end 102 in connection with the height adjust cable spool 98 and a lifting member connecting end 104 in connection with a metal plate 106 welded to a bottom end 108 of lifting member 88 such that when the height adjust cable spool 98 rotates in a first rotational direction, the height adjust cable 100 supplies a lifting force to elongated lifting member 88 such that first beam end 18 is raised and when height adjust cable spool 98 rotates in a second rotational direction, opposite to the first rotational direction, the height adjust cable 100 supplies a lowering force to elongated lifting member 88 such that first beam end is lowered. In this embodiment the height of each of the first and second beam ends 18,20 is independently adjustable so that I-beam 16 may be orient in parallel to the ground or at an operator selected angle with respect to the ground.

It can be seen from the preceding description that an I-beam walk assist device has been provided.

It is noted that the embodiment of the I-beam walk assist device described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. The I-beam walk assist device for supplying a lifting force to a patient wearing a patient lifting harness having two attachment points; said I-beam wall assist device comprising:

first and second individually adjustable height I-beam support assemblies;

an I-beam having a first beam end supported by said first adjustable height I-beam support assembly and a second I-beam end supported by said second adjustable height I-beam support assembly, a gantry crane rollably mounted onto said I-beam and rollable along a section of said I-beam;

a first and a second user controlled I-beam support assembly height adjustment winch in mechanical connection, respectively, with one of said first or second individually adjustable height I-beam support assemblies; and a patient harness connecting mechanism in connection with said gantry crane and having attachment structures for attaching a patient support harness thereto;

said gantry crane including a rollable trolley supporting a user controllable electric patient support winch having a lift/lower control device that includes an extend/retract switch mechanism for allowing an operator to extend and retract a flexible support cable connected at one end to a winch spool of said user controllable electric patient support winch and in mechanical lifting connection with said patient harness connecting mechanism;

each of said first and second individually adjustable height I-beam support assemblies including a horizontal support member, an outer vertical support tube extending upward from a top center of said horizontal support member and having a tubular passageway therein open at a top outside tube end thereof and an outer vertical support tube surface to which a guide tube with a guide tube passageway is rigidly attached, and an inner vertical support assembly having an elongated inner slide portion slidably positioned in connection with said tubular passageway of said outer vertical support tube, a top plate mounted to a top slide portion end in connection with a respective first or second beam end, and an elongated lifting member in parallel orientation with said elongated inner slide portion, in mechanical force transmitting connection with said elongated inner slide portion and slidably positioned in connection with said guide tube passageway of said guide tube;

each of said first and second user controlled height adjustment winches being in mechanical connection with a respective one of said first and second individually adjustable height I-beam support assemblies, and having a height adjust extend/retract control switch mechanism for controlling said direction of rotation of a height adjust cable spool and a height adjust cable having a spool connecting end in connection with said height adjust cable spool and a lifting member connecting end in connection with said lifting member such that when said height adjust cable spool rotates in a first rotational direction, said height adjust cable supplies a lifting force to said elongated lifting member such that said respective first or second beam end is raised and when said height adjust cable spool rotates in a second rotational direction, opposite to said first rotational direction, said height adjust cable supplies a lowering force to said elongated lifting member such that said respective first or second beam end is lowered;

the height of said first and second beam ends being adjustable to the same or different heights by an operator.

* * * * *